US006527265B1

(12) United States Patent
Goodding

(10) Patent No.: US 6,527,265 B1
(45) Date of Patent: Mar. 4, 2003

(54) FASCIA INSTALLATION APPARATUS

(76) Inventor: Clinton Goodding, 2311 W. Apache, Farmington, NM (US) 87401

( * ) Notice: Subject to any disclaimer, the term of this patent is extended or adjusted under 35 U.S.C. 154(b) by 0 days.

(21) Appl. No.: 10/079,236

(22) Filed: Feb. 19, 2002

Related U.S. Application Data

(60) Provisional application No. 60/270,080, filed on Feb. 20, 2001.

(51) Int. Cl.[7] ..... B23L 1/25

(52) U.S. Cl. ..... 269/69; 269/41; 269/45; 269/904; 269/97; 52/702

(58) Field of Search ..... 269/69, 41, 45, 269/152–155, 37, 904, 43, 97, 98, 82–85; 29/281.5, 281.1; 52/702, 127, 712; 248/215

(56) References Cited

U.S. PATENT DOCUMENTS 4,165,869 A * 8/1979 Williams ..... 269/41
4,836,517 A * 6/1989 Vossier ..... 269/41
5,192,059 A * 3/1993 Silver ..... 269/41
5,228,667 A * 7/1993 Bridgegum ..... 269/45

* cited by examiner

*Primary Examiner*—M. Rachuba
*Assistant Examiner*—Daniel Shanley
(74) *Attorney, Agent, or Firm*—Rod D. Baker; Peacock, Myers & Adams, P.C.

(57) ABSTRACT

A portable apparatus for supporting and maintaining fascia in proper position during installation upon the exterior of a building, such as a residential dwelling. A forked member is temporarily attached to the eave of the building. A cross member is connected to the forked member. The vertical position of the cross member, relative to the forked member, is adjustable and temporarily fixable. A support member, upon which the fascia rests and is supported, is connectable to the cross member. The horizontal position of the support member, relative to the cross member, is adjustable and temporarily fixable. By selectively adjusting the horizontal position of the support member, and by selectively adjusting the vertical position of the cross member to which the support member is connected, the position of the support member, and thus the fascia, is precisely adjustable in two dimensions. The apparatus thus permits the fascia to be held in proper place while the user permanently installs the fascia to the building.

13 Claims, 9 Drawing Sheets

FASCIA INSTALLATION APPARATUS

CROSS-REFERENCE TO RELATED APPLICATIONS

This application claims the benefit of the filing of U.S. Provisional Patent Application Serial No. 60/270,080 entitled Fascia Installation Apparatus, filed on Feb. 20, 2001, and the specification thereof is incorporated herein by reference.

BACKGROUND OF THE INVENTION

1. Field of the Invention (Technical Field)

The present invention relates to building construction apparatus, particularly tools and devices for installing fascia upon commercial or residential buildings, and specifically relates to an apparatus for temporarily holding finish fascia in place upon subfascia during permanent installation.

2. Background Art

Previously issued patents that serve as background in the field of the present invention include U.S. Pat. No. 5,611,189 to Fleck, U.S. Pat. No. 5,192,059 to Silver, U.S. Pat. No. 5,785,306 to Wilson, et al., U.S. Pat. No. 4,314,429 to Casteel, et al., U.S. Pat. No. 4,158,455 to Brown, U.S. Pat. No. 5,088,682 to Gibbs, U.S. Pat. No. 4,836,517 to Vossler, and U.S. Pat. No. 2,686,960 to Roy. However, previous attempts have been directed principally to the installation of subfascia rather than finish fascia, and have done little or nothing to enable the user to adjust the tool to accommodate fascia of differing heights or thicknesses.

SUMMARY OF THE INVENTION (DISCLOSURE OF THE INVENTION)

The present invention relates to an apparatus for temporarily, but securely, holding fascia, especially finish fascia, in proper position upon a structure while the user effectuates the permanent fixture of the fascia in place. Once the fascia is permanently installed, the apparatus may then be released for re-use at a different location.

Thus, there is provided a portable apparatus for supporting and maintaining fascia in proper position during installation upon the exterior of a building, such as a residential dwelling. A forked eave member is temporarily attached to the eave of the building. A cross member is connected to the forked eave member. The vertical position of the cross member, relative to the eave member, is adjustable and temporarily fixable. A support member, upon which the fascia rests and is supported, is connectable to the cross member. The horizontal position of the support member, relative to the cross member, is adjustable and temporarily fixable. By selectively adjusting the horizontal position of the support member, and by selectively adjusting the vertical position of the cross member to which the support member is connected, the position of the support member, and thus the fascia, is precisely adjustable along two axes (vertical and horizontal). The apparatus thus permits the fascia to be held temporarily in proper place while the user permanently installs the fascia to the building.

The apparatus includes three principal parts, and several minor elements A vertical inverted forked eave member is temporarily secured to the underside of the eave, as by screwing the base of the eave member to the outer eave board or to the soffit. A horizontal cross member is attached to the at least one, preferably two legs of the inverted eave member, by inserting removable keeper pins through aligned holes in the horizontal cross member and the one or two legs of the inverted eave member. Various pairs of holes are alignable, so that the vertical position of the horizontal cross member is adjustable in relation to the vertical eave member. A third vertical support member is attachable to the horizontal cross member, also by using keeper pins insertable into aligned holes in the cross member and the vertical support member. Various pairs of holes are alignable, so that the horizontal position of the support member is adjustable in relation to both the horizontal cross member and the inverted forked member.

According to the invention, there is provided a portable apparatus for installing fascia upon a building having a roof and an eave, the eave having a subfascia, the apparatus comprising a forked member removably attachable to the eave, the member having two downwardly extending legs; a cross member connectable to the legs of the forked member, the cross member adjustably movable vertically in relation to the forked member; a vertical support member connectable to the cross member and slidably adjustable horizontally in relation to the cross member, the support member comprising surfaces for receiving and supporting the fascia in an installation position; means for selectively temporarily fixing the vertical position of the cross member in relation to the forked member; and means for selectively temporarily fixing the horizontal position of the support member in relation to the cross member. In the preferred embodiment, the forked member comprises a base defining therein a slotted hole for receiving an attachment screw.

In the preferred embodiment of the invention, the cross member comprises a pair of extending hooked arms, each arm defining an interior vertical channel for receiving, in slidable engagement, a corresponding one of the legs, wherein the slidable engagement of the legs in the vertical channels prevents horizontal movement of the cross member in relation to the forked member. Further, the vertical support member preferably defines an opening for receiving, in slidable horizontal inserted engagement, the cross member, wherein the slidable engagement of the cross member into the opening prevents vertical movement of the support member in relation to the cross member. The preferred means for selectively temporarily fixing the vertical position of the cross member in relation to the forked member comprises at least one vertical adjustment hole defined in each of two opposing sides of the cross member; a plurality of adjustment holes defined in the legs of the forked member, the holes selectively alignable with the vertical adjustment holes in the sides of the cross member; and a pair of keeper pins removably insertable in selectively aligned pairs of the adjustment holes. Similarly, the preferred means for selectively temporarily fixing the horizontal position of the support member in relation to the cross member comprises: a plurality of horizontal adjustment holes defined in each of two opposing sides of the cross member; at least one adjustment hole defined in each of two opposing sides of the support member, the holes selectively alignable with the horizontal adjustment holes in the sides of the cross member; and a pair of keeper pins removably insertable in selectively aligned pairs of the adjustment holes.

A primary object of the present invention is to provide a simple, inexpensively manufactured apparatus for use in building construction, to temporarily hold finish fascia in place upon subfascia during installation.

A primary advantage of the present invention is that it permits horizontal as well as vertical adjustment, thereby permitting the use of the apparatus with fascia of different thicknesses.

Another advantage of the invention is that the apparatus of the invention is easily manipulated and used, and may be used by a single person in operation to hang lengthy sections of fascia.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

The present invention has to do with the building construction trade. The invention will find use in the construction of all types of building construction, including industrial and commercial, but is most readily applicable in residential building construction. After a building has been framed, and the roof decking installed, it is necessary to cover the fundamental structural components of the building with finish elements to protect the structure from the elements and to beautify its appearance.

One of the fundamental structural components of a typical residential building is the subfascia. The subfascia is the rigid structural member, typically a two-by-four or two-by-six inch board, which runs parallel to the ground along the ends of the roof rafters that define the eave of the roof. The subfascia usually runs perpendicular to the rafters, and joins their ends together to lend structural strength to the roof. The subfascia, being a primarily structural component, is then covered with a finish fascia. The finish fascia is installed directly upon, and flush against, the subfascia to protect the subfascia from the weather and to beautify the structure. Finish fascia may be fashioned from treated wood, plastic or vinyl, aluminum, galvanized steel, or other materials finished to be aesthetically attractive and relatively weatherproof.

Commonly, finish fascia is attached to the subfascia using screws, nails or other fasteners, or glue. Regardless of the type of fasteners used, it is necessary to hold the finish fascia in proper place upon the subfascia while the fasteners are installed to permanently secure the finish fascia in place. The finish fascia must not only be maintained horizontal, but its vertical position with respect to the subfascia must be controlled. The task of temporarily holding the finish fascia in proper vertical position, as well as generally horizontal, is difficult to accomplish while simultaneously attempting to permanently secure the finish fascia to the subfascia. The task is particularly daunting in those instances, which are increasingly common, where a single person or perhaps two persons—rather than a team of three or four workers—is installing the finish fascia.

The present invention solves the problem by providing an apparatus that temporarily, yet reliably, holds the finish fascia in proper position upon the subfascia while the finish fascia is permanently secured to the building. While intended primarily for use in installing finish fascia, the present invention may find application in the task of installing subfascia as well.

The apparatus is comprised of three principal components, which may be crafted from aluminum, heavy duty plastic, metallic alloys, or other rigid and durable materials that may be machined, and pieces joined by welding, brazing, or epoxy or other advanced adhesives.

Figure 1A:
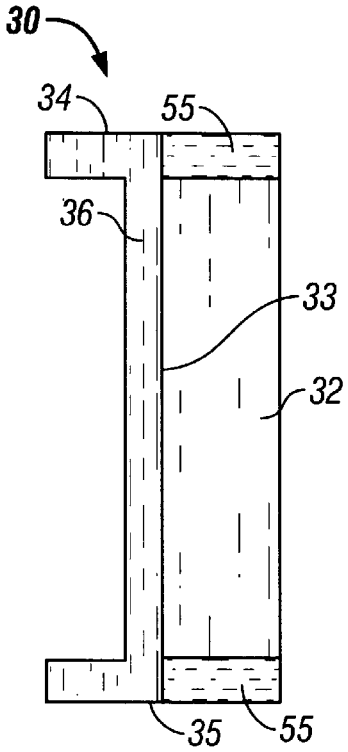
FIG. 1A is a top view of the vertical support member according one embodiment of the apparatus of the invention.
Figure 1B:
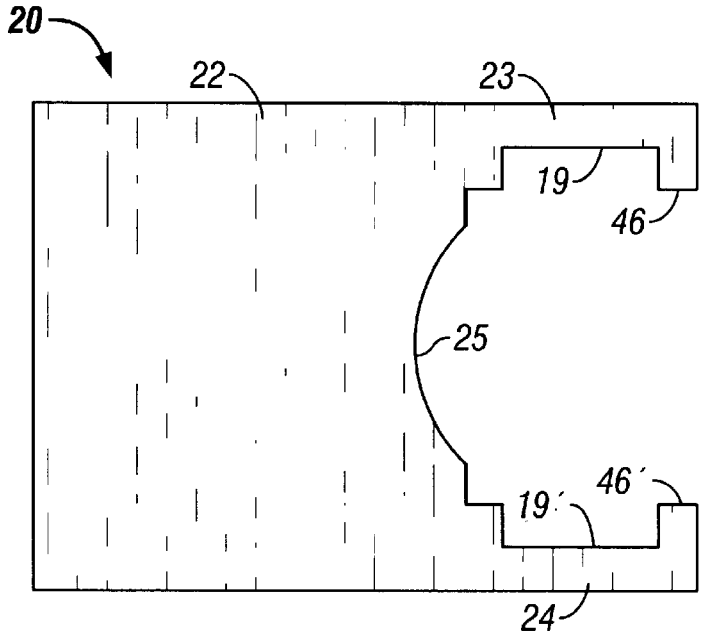
FIG. 1B is a top view of the horizontal cross member according to one embodiment of the apparatus of the invention.
Figure 1C:
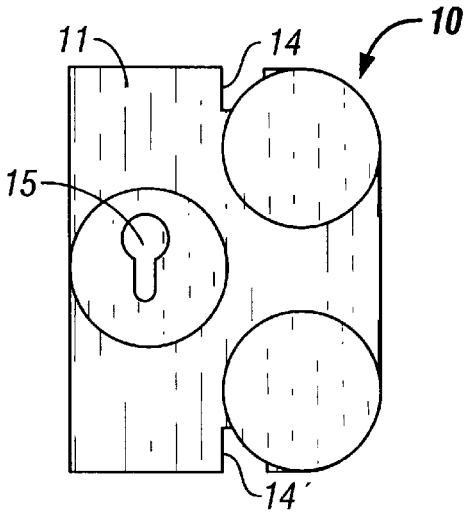
FIG. 1C is a top view of the forked eave member according one embodiment of the apparatus of the invention.
Figure 1D:
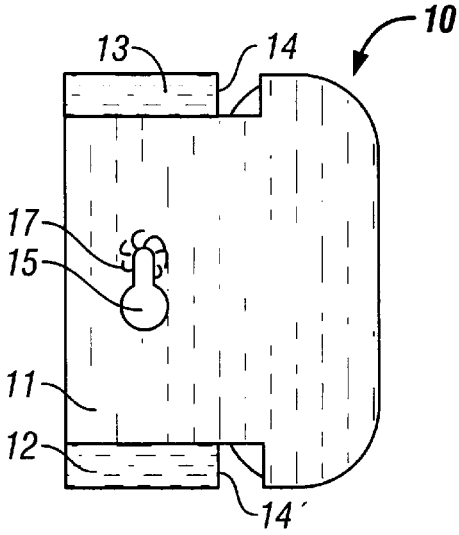
FIG. 1D is a bottom view of the forked eave member shown in FIG. 1C.
Figure 2A:
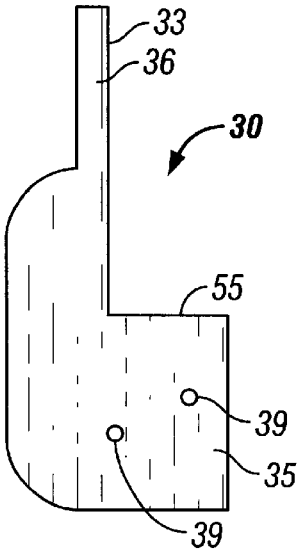
FIG. 2A is a right side view of the vertical support member shown in FIG. 1A.
Figure 2B:
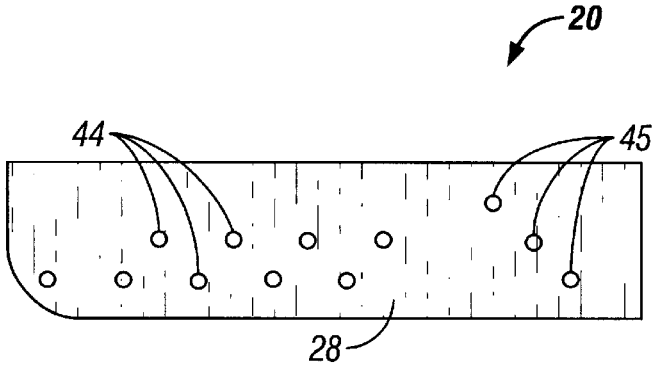
FIG. 2B is a right side view of the horizontal cross member shown in FIG. 1B.
Figure 2C:
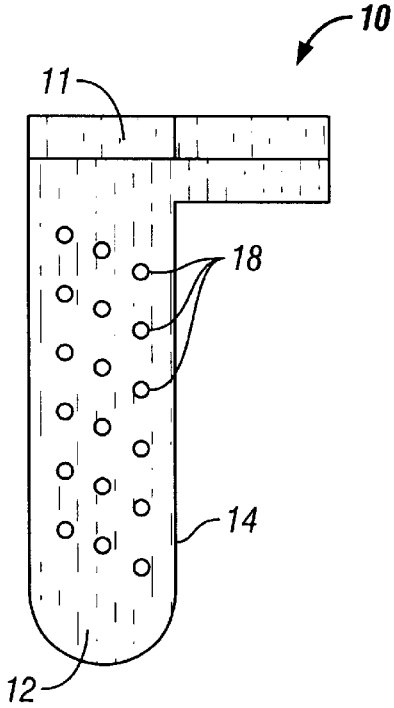
FIG. 2C is a right side view of the forked eave member shown in FIG. 1C.
Figure 3A:
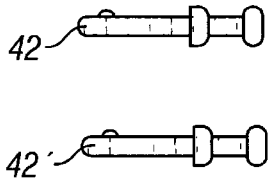
FIG. 3A shows a pair of keeper pins useable to adjustably conjoin the forked eave member and the horizontal cross member.
Figure 3B:
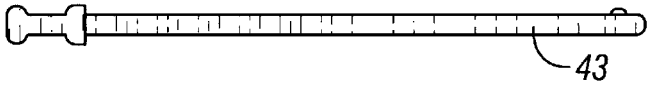
FIG. 3B shows a keeper pin useable to adjustably conjoin the horizontal cross member and the vertical support member.

FIGS. 1A, 1B and 1C are top views of the vertical support member 30, the cross member 20, and the eave member 10 respectively. The top view of the eave member 10, shows the slotted hole 15 for the mounting screw 56. The bottom view of the eave member 10 seen in FIG. 1D shows the countersink 17 for the screw head. FIGS. 2A, 2B, and 2C are side views of the support member 30, cross member 20, and forked eave member 10, respectively. FIGS. 3A and 3B illustrate keeper pins useable with the invention to adjust the position of the finish fascia vertically and honzontally, FIGS. 4A, 4B, and 4C show the vertical support member 30, cross member 20 and the forked Cave member 10 from the "back," that is, as they would appear when the user is facing the structure (as viewed in FIG. 6, or from the left in FIG. 5).

Figure 4C:
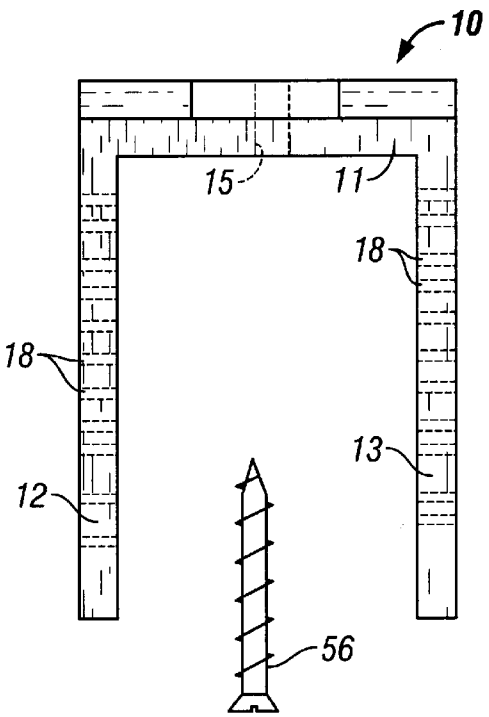
FIG. 4C is a rear elevation view of the forked member shown in FIG. 1C, with a screw useable for temporarily securing the forked member in place upon the building.
Figure 4A:
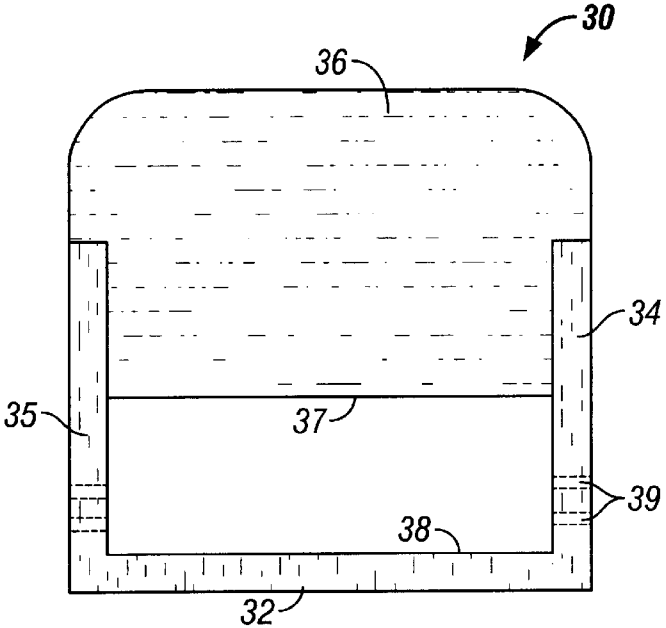
FIG. 4A is a rear elevation view of the vertical support member shown in FIG. 1A.

Vertical support member 30 is depicted in FIGS. 1A, 2A, and 4A. Support member 30 is a rigid integrated piece featuring a U-shaped body having a bottom 32, and parallel sides 34, 35; the sides 34, 35 are connected to support plate 36. As seen in the figures, the sides 34, 35 are perpendicular to the support bottom 32, and the support plate 36 is in a plane perpendicular to the bottom 32, so that the sides 34, 35, support bottom 32 and support plate 36 are all mutually orthogonal. The inside vertical surface of the support plate 36 defines a fascia face 33. The sides 34, 35 serve as stand-offs to hold the support plate 36 above and apart from the support bottom 32, with the bottom edge of the plate 36 substantially parallel to the bottom 32. The support sides 34, 35, the support bottom 32 and the bottom edge 37 of the support plate 36 collectively define a vertical support assembly opening 38, as best seen in FIG. 4A. Each of the two sides 34, 35 is penetrated by at least a pair of attachment holes 39 that are used to temporarily and adjustably connect the vertical support member 30 to the cross member 20. Referring to FIGS. 1A and 2A, it is seen that the upper inside edges of the sides 34, 35 of the support member define step ledges 55.

Figure 4B:
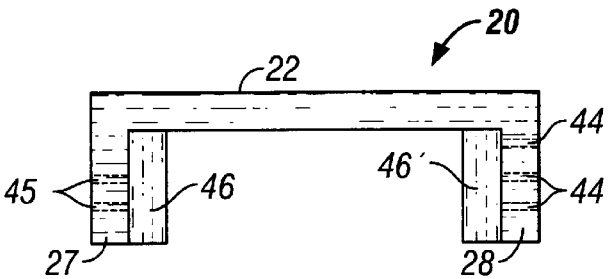
FIG. 4B is a rear elevation view of the horizontal cross member shown in FIG. 1B.

Cross member 20 is a single, specially shaped component illustrated in FIGS. 1B, 2B, and 4B. Cross member 20 is an integral rigid piece, having a planar top 22 from which a pair of hooked arms 23, 24 extend, as seen in FIG. 1B. The top 20 has an interior edge 25 that is specially scalloped as seen in FIG. 1B. The interior edge 25 and hooked arms 23, 24 surround and define on three sides a cross member well or opening. Extending down from side edges of the top 22 of the cross member 20 are a pair of identical cross member sides 27, 28, one seen in FIG. 2B. One end of each side is rounded in the manner seen in FIG. 2B. Each side 27, 28 is penetrated by two groups of arrayed adjustment holes 44, 45 also as seen (twelve shown) in FIG. 2B. The holes 44 are horizontal adjustment holes for providing horizontal selectivity of the positioning of the finish fascia 60, while holes 45 are vertical adjustment holes. The sides 27, 28 also are hooked, with inwardly extending flanges 46, 46' as seen in FIGS. 1B and 4B.

The third main component is eave member 10, depicted in FIGS. 1C, 1D, 2C, and 4C. Eave member 10 has a generally planar base 11 from the edges of which rigidly extend at least one and preferably two parallel legs 12, 13. A slotted hole 15 completely penetrates the base 11 between the legs 12, 13, slightly offset from the base's center as seen in FIGS. 1C and 1D. The base 11 is disposed at the top of the forked member 10 when the apparatus is in use; the legs 12, 13 extend downwardly as seen in FIG. 4C. As seen in FIG. 1D, the slotted portion of the slotted hole 15 has a countersink 17 on the undersurface of the base 11 to receive the head of a screw flush with the base, as described further herein. As illustrated in FIG. 2C, each of the legs 12, 13 is completely penetrated by a plurality of about eighteen (more or less) forked member adjustment holes 18, arrayed in inclined rows of, for example, three holes per row It is noted that the forked adjustment holes 18 on each leg 12 or 13 are pitched in patterns corresponding to the pattern and number of vertical adjustment holes 45 in the cross member 20. Accordingly, the three vertical adjustment holes 45 in each side 27 or 28 of the cross member may be aligned with any selected row of three forked adjustment holes 18 in a leg of the forked member 10.

Similarly, the horizontal adjustment holes 44 in each side of the cross member 20 are arrayed in pairs that are alignable with the pairs of holes on each side 34 and 35 of the support member 30. Thus, when the support member 30 is temporarily connected to the cross member 20 as further described herein, the horizontal position of the support member 30 5 relative to the cross member 20 is selectively adjustable by aligning a particular selected pair of horizontal adjustment holes 44 in a side of the cross member with the pair of holes 39 in a corresponding side of the support member 30.

Figure 5:
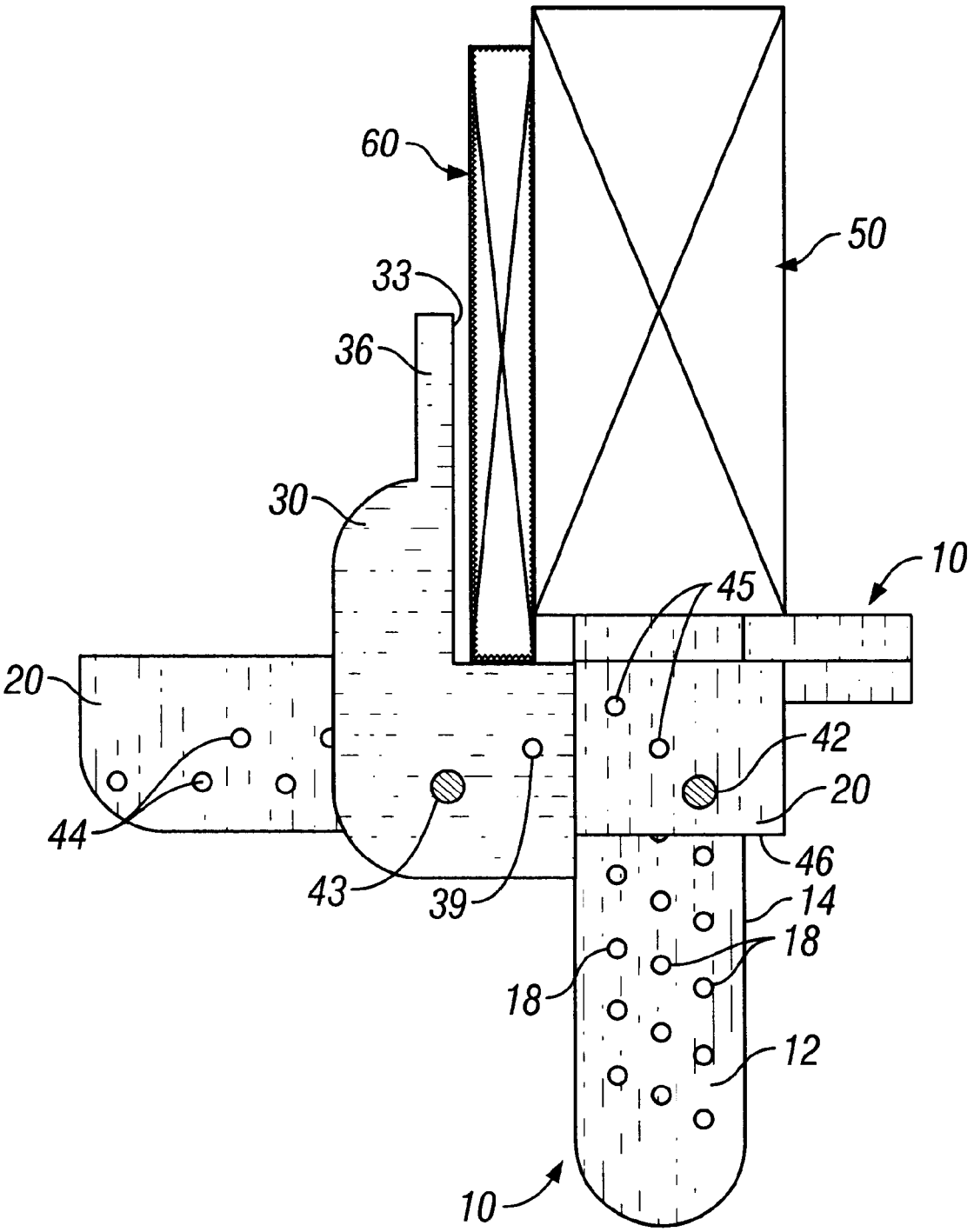
FIG. 5 is a right side view of the apparatus of the invention in use to hold temporarily a section of finish fascia (shown in cross section) in place upon a length of subfascia (shown in cross section)
Figure 6:
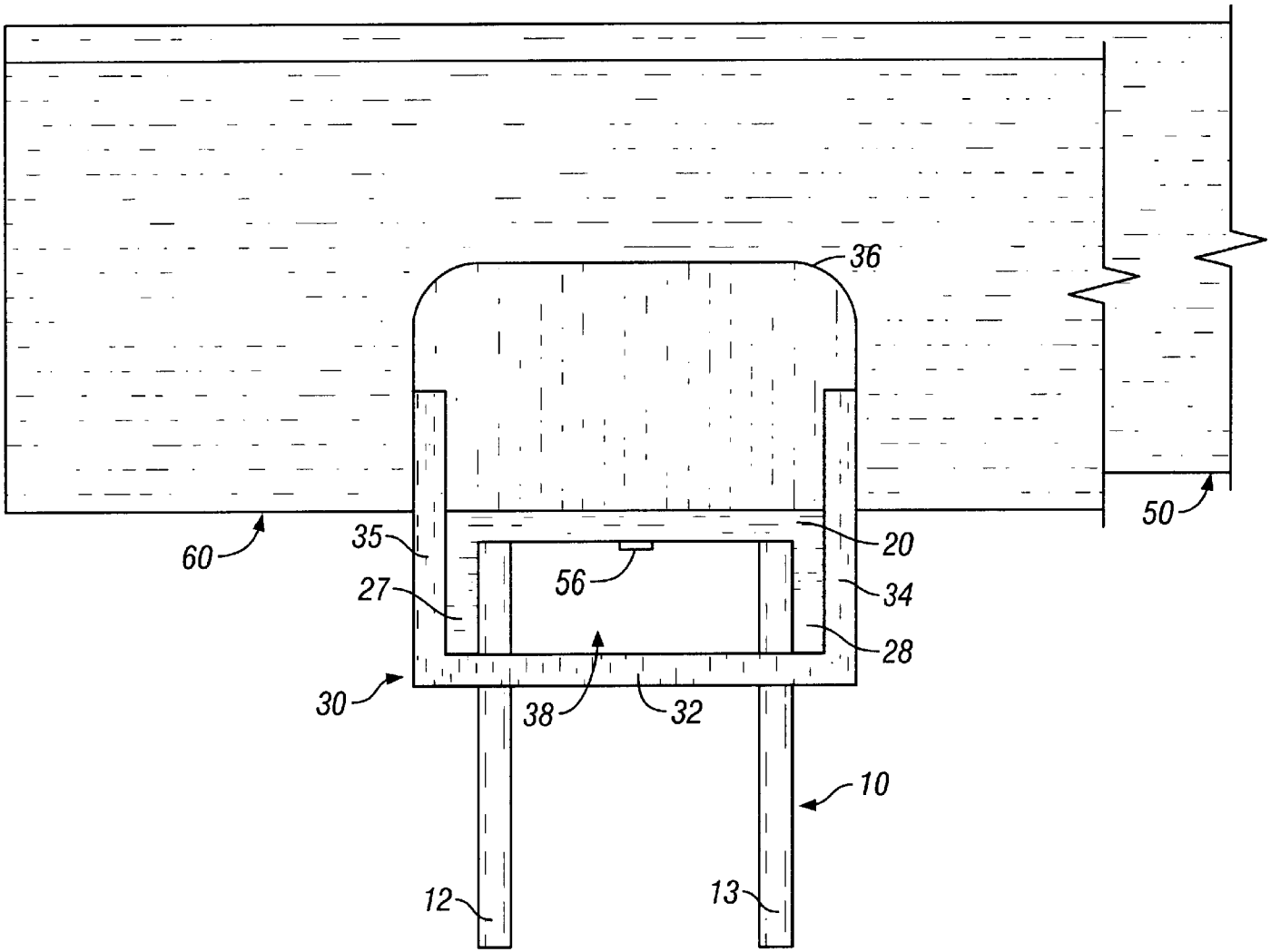
FIG. 6 is a rear elevation of the apparatus as seen in FIG. 5.
Figure 7:
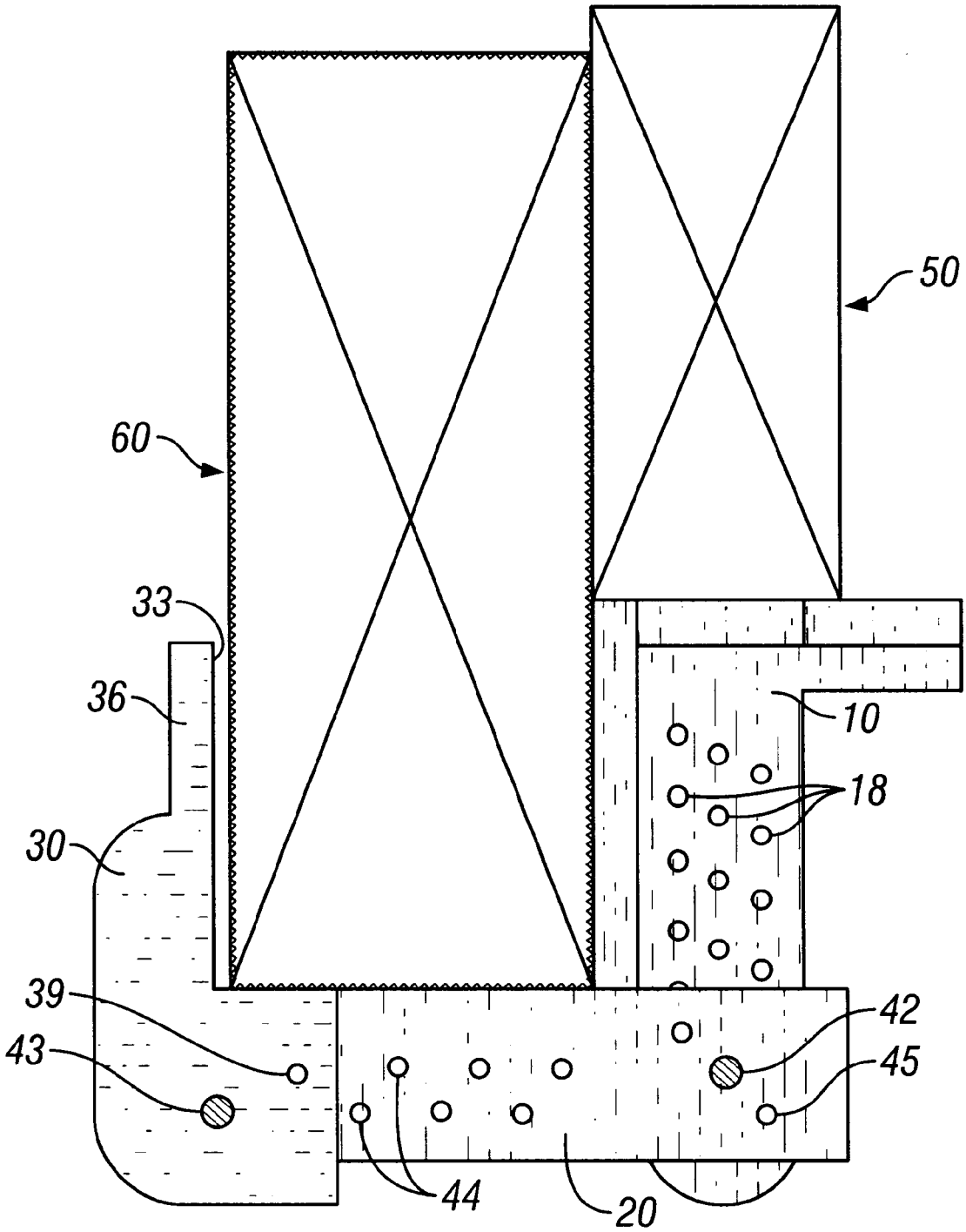
FIG. 7 is an alternative right side view of the apparatus of the invention, showing the apparatus adjusted to accommodate a section of finish fascia of much different thickness and height from that depicted in FIG. 5.
Figure 8:
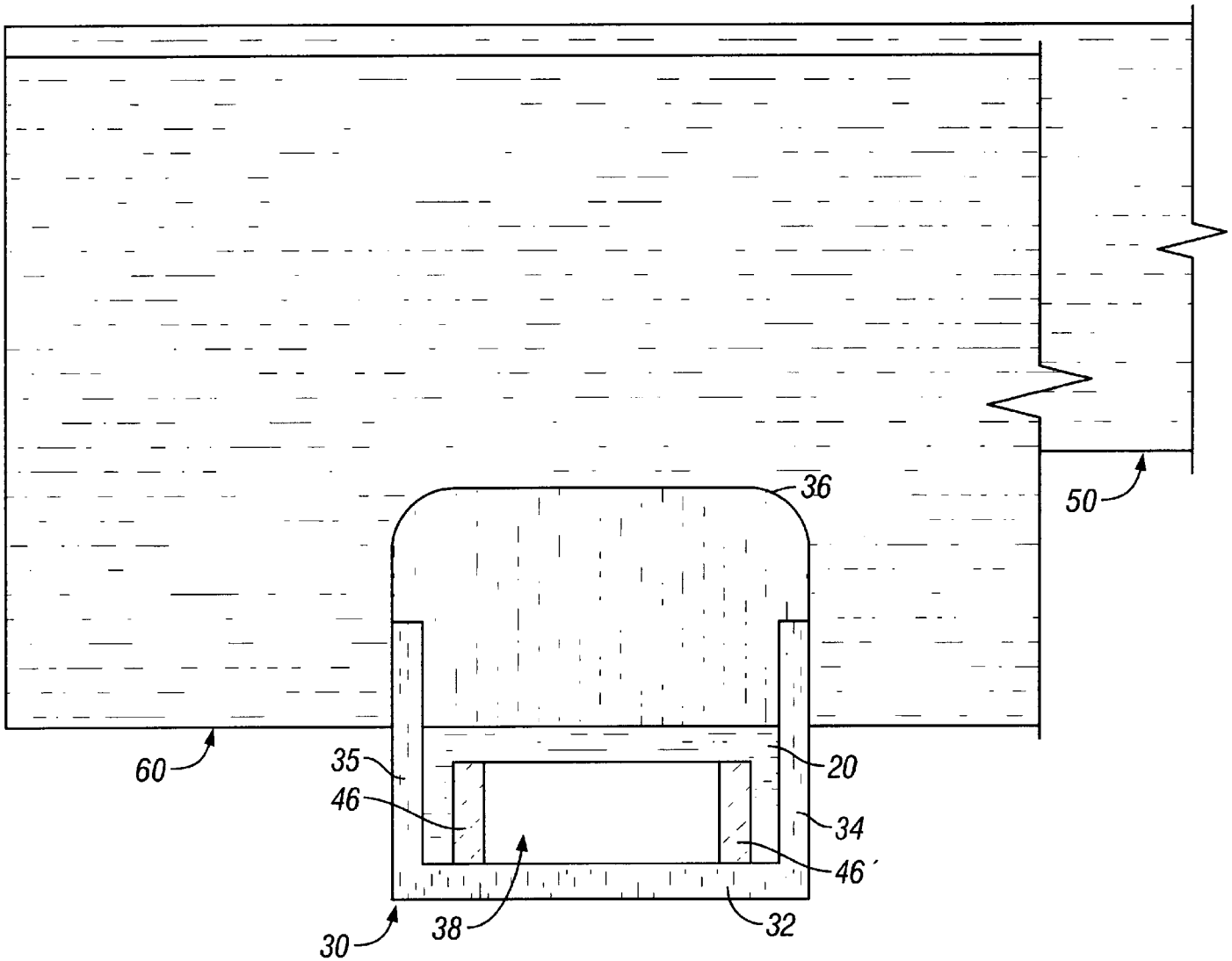
FIG. 8 is a rear elevation view of the apparatus of the invention as seen in FIG. 7.

Assembly and installation of the apparatus of the invention is explained with collective reference to FIGS. 5–12. In FIG. 5, the apparatus is seen assembled, adjusted and fastened to the sub fascia. Adjusted by the pin-and-hole combination, the apparatus supports finish fascia 60 of a certain thickness and at a pre-selected point below the bottom edge of the sub fascia 50. FIG. 6 shows the apparatus supporting the finish fascia 60 below the bottom edge of the sub fascia 50. In FIG. 7, the apparatus is assembled, adjusted and fastened to the sub fascia 50. Adjusted by the pin-and-hole combination, the apparatus supports finish fascia 60 of another thickness, and at a different level below the bottom edge of the sub fascia 50, from the depiction of FIG. 6. FIG. 8 similarly shows the apparatus supporting the finish fascia 60 below the bottom edge of the sub fascia 50.

Figure 9:
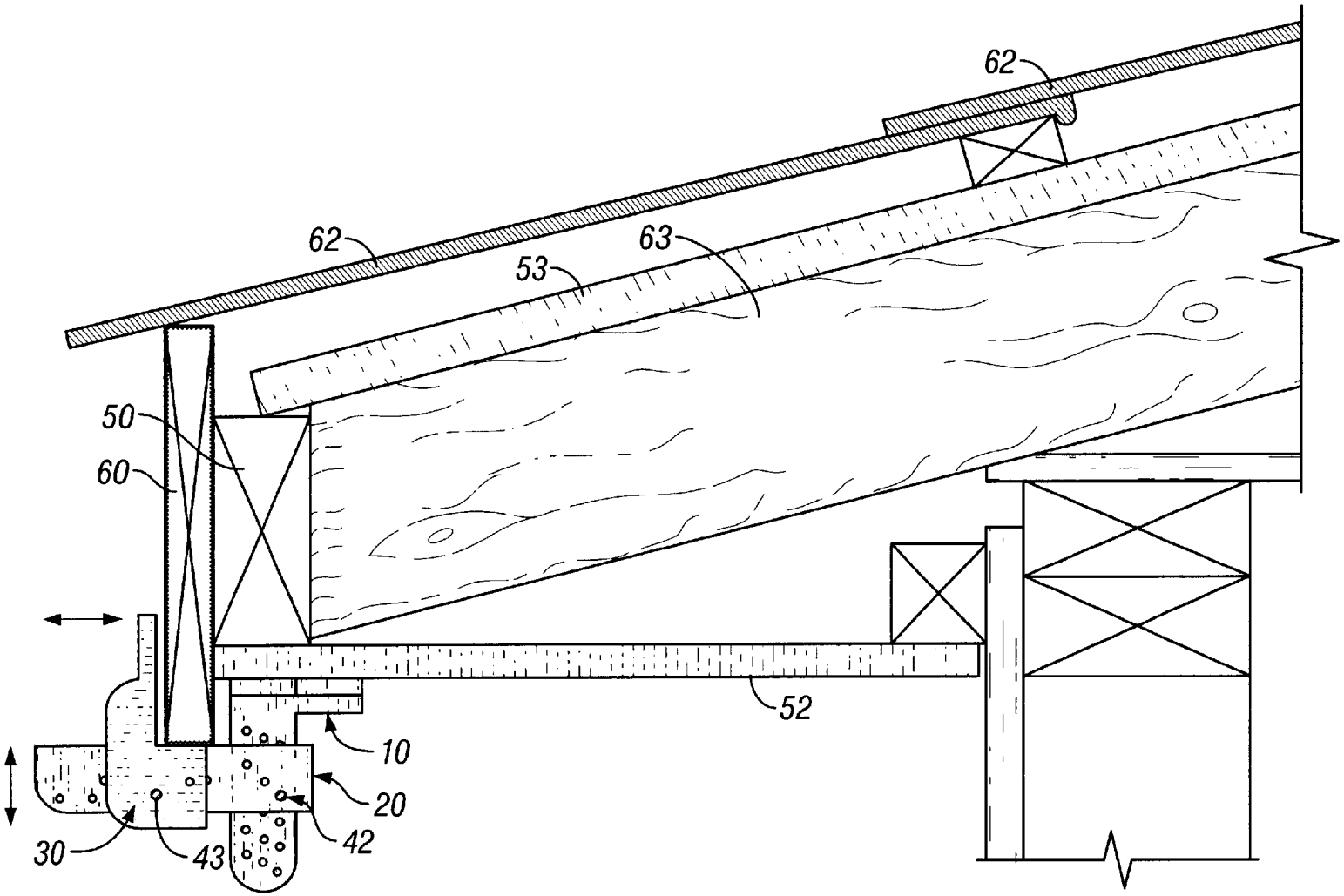
FIG. 9 is a right side view, showing the apparatus of the invention in use, and depicting the positional relationship of the apparatus in relation to the various elements of the building upon which the apparatus is in use.
Figure 10:
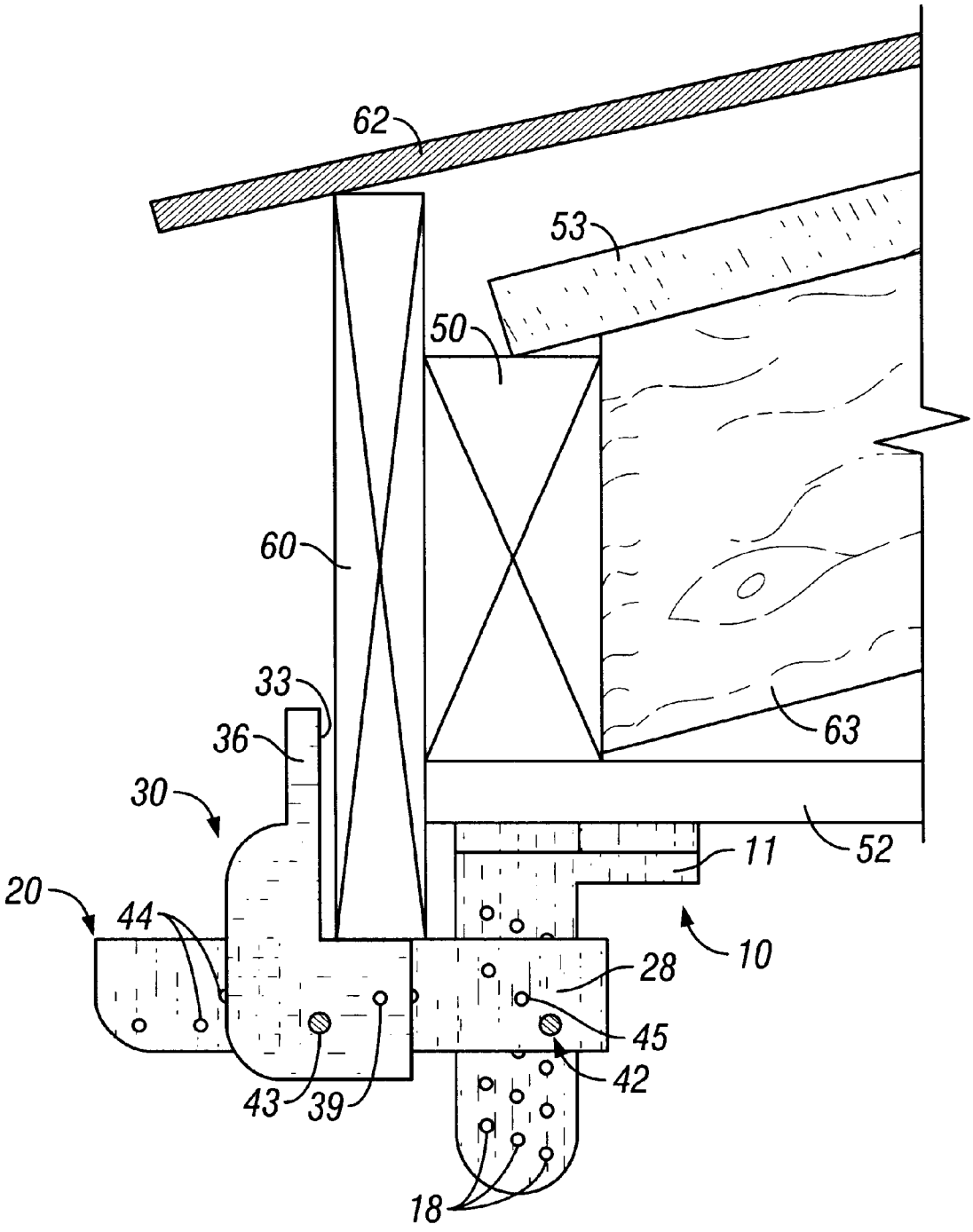
FIG. 10 is an enlarged view of a portion of FIG. 9, depicting the apparatus of the invention in use.

In FIG. 9, the apparatus is used to allow finish fascia 60 to extend past the top of the roof deck 53 when the finish fascia 60 is used to support roof tile 62, and also to allow the finish fascia 60 to extend below the bottom of the soffit 52. FIG. 9 is an approximately to-scale drawing of building structure framing, with the apparatus supporting finish fascia 60 where the finish fascia extends past the roof deck 53 at the top edge of the sub fascia 50 to support roof tile 62, and also extends past the soffit 52 at the bottom edge of the sub fascia 50. FIG. 10 is an enlarged view of the apparatus as depicted in FIG. 9.

The vertical inverted forked member 10 is temporarily secured to the underside of the eave, for example by screwing with screw 56 the base 11 of the forked eave member 10 to the subfascia 50 or to the soffit 52 (as seen in FIGS. 4C, 6). The base 11 of the forked member 10 is temporarily attached to the structure, and the legs 12, 13 hang downward. The horizontal cross member 20 is slipped around the legs of the forked member 10, with the sides 27, 28 in sliding contact generally against the outside faces of the legs 12, 13 of the eave member 10. The cross member 20 is situated approximately horizontally, and the vertical adjustment holes 45 on each side of the cross member are aligned with the holes 18 in a selected row of holes in each of the legs 12 and 13 of the forked eave member 10.

Typically, the cross member 20 is positioned by slipping it upward along the downwardly extending legs 12, 13 of the forked member 10. The legs 12, 13 of the forked member 10 have sliding contact with the inside surfaces of the hooked arms 23, 24 of the cross member 20. The widths of the interior vertical channels 19, 19' defined in the inside surfaces of the arms 23, 24 correspond generally to the widths of the legs 12, 13, so that the flanges 46, 46' ride in sliding contact with the inside edges 14, 14' of the legs 12, 13 (e.g., FIG. 5). Thus, it is seen that the legs 12, 13 engage into the vertical channels 19, 19' to prevent horizontal movement of the cross member 20 in relation to the forked member 10; relative to the forked member 10, the cross member 20 is capable of sliding vertical movement only.

The horizontal cross member 20 is temporarily attached to the two legs 12, 13 of the inverted forked member 10 by inserting removable keeper pins 42, 42' (FIG. 3A) through the aligned holes 45, 18 in the horizontal cross member 20 and the legs 12 and 13 of the inverted forked member 10. Because any one of the rows (six rows shown) of holes 18 in the legs 12 and 13 are alignable with the row of vertical adjustment holes 45 in each side of the cross member 20, the vertical position of the horizontal cross member 20 is selectively adjustable in relation to the vertical forked member 10.

The vertical support member 30 is then attachable to the horizontal cross member 20, also by using one or two keeper pins, such as keeper pin 43 (FIG. 3B), insertable into aligned holes 44 and 39 in the cross member 20 and the vertical support member 30, respectively.

Various pairs of horizontal adjustment holes 44 are alignable with the holes 39 in the support member 30, so that the horizontal position of the support member 30 is adjustable in relation to the horizontal cross member 20, which in turn is connected to the inverted forked member 10.

Continued collective reference is made to FIGS. 5–12. The vertical forked member 10 has the slotted hole 15 in its base, as best seen in FIGS. IC and ID. As suggested by FIG. 4C, a screw 56 is used to temporarily mount the vertical forked member 10 to the underside of the rafter, subfascia 50 or soffit 52. The screw 56 is driven nearly all the way in, but then the head of the screw 56 is insertable through the slotted hole 15 seen in FIGS. IC and ID. The forked member 10 is moved into the proper position, as seen in FIGS. 5, 6, 9 and 10, with the mounting screw 56 in the narrower slot portion of hole 15. The mounting screw 56 is tightened until its head presses into the countersink 17 seen in FIG. 1D.

Horizontal cross member 20 is then adjustably connectable to the forked member 10 using the pair of keeper pins 42, 42' seen in FIG. 3A. Notably, the vertical position of the horizontal cross member 20 is selectively adjustable by using any two pairs of aligned adjustment holes 45 and 18 in the opposing sides of the horizontal cross member 20 and in the legs 12 and 13 of the forked member 10 respectively. As seen best in FIG. 2C, the each leg 12, 13 of the forked member 10 has a series of parallel rows of adjustment holes 18 therein, providing for attachment of the horizontal cross member 20 at differing heights upon the forked member 10. The lines of holes 18 are arranged in slanted or oblique arrays (in the figures, arrays of three holes per line) to enhance the security of the releasable connection between the cross member 20 and the forked member 10 while the apparatus is in use. As seen in FIG. 2B, each side 27, 28 of the cross member 20 has a slanted array of three vertical adjustment holes 45 that are alignable with any one of the rows of adjustment holes 18 in the forked member 10. By selectively aligning the vertical adjustment holes 45 with corresponding holes 18, and then inserting one or more keeper pins 42, 42' in the aligned holes, the vertical position of the cross member 20, in relation to the forked member 10 and thus with respect to the subfascia 50, can be adjusted and temporarily fixed by the user. The keeper pins 42, 42' are removable by twisting and manual extraction to break the apparatus down for relocation and re-use. A variety of keeper pins may be used, including breakable, disposable plastic pins, cotter pins, or reusable pins with compressible detents or ridges; suitable keeper pins are commercially available or customized pins are within the knowledge of one or ordinary skill in the art.

The vertical support member 30 is then engaged with the cross member 20 by sliding the cross member, axially, through the opening 38 in the support member 30. The sliding engagement is provided by slipping the support member 30 around the cross member 20 extending horizontally outward from the subfascia 50. The vertical outside faces of the sides 27, 28 of the cross member 20 preferably are in flush sliding contact with the inside faces of the sides 34, 35 of the support member 30, while the top 22 of the cross member is in smooth sliding contact with the bottom edge 37 of the support plate 36. Similarly, the bottom edges of the sides 27, 28 of the cross member 20 ride smoothly upon the top surface of the support bottom 32. Thus, the maximum outside dimensions of the cross member 20 (i.e. the height and width as seen in FIG. 4B) correspond very closely to the height and width dimensions of the opening 38 in the vertical support member 30, thereby providing a close, fitted, sliding insertion of the cross member 20 into the opening 38 to associate the components 20, 30 together in operative engagement. Notably, the vertical support member 30 is capable of horizontal movement only in relation to the cross member 20; the sliding insertion of the cross member 20 into the opening 38 of the support member 30 permits such sliding horizontal shifting, while preventing the support member from moving up and down relative to the cross member 20 (and thus the subfascia 50).

Referring, for example, to FIGS. 5 and 7, it is seen that the support member 30 is slipped into position with the support plate 36 extending upward, and with the fascia face 33 adjacent to and in confronting relation with the subfascia 50. The fascia face 33 of the support member 30 is the vertical element that presses against and supports the finish fascia 60 in proper vertical position for attachment to the subfascia 50.

The vertical support member 30 is connectable to the horizontal cross member 20 by means of the long keeper pin 43 shown in FIG. 3B. The pair (or more) of adjustment holes 39 on each side 34 and 35 of the vertical support member 30 as seen in FIG. 2A for instance, are selectively alignable with the horizontal adjustment holes 44 seen in FIG. 2B. Thus, at least one hole 44 on each side of the horizontal cross member 20 is alignable with a corresponding hole 39 on each side of the vertical support member 30, and the four such holes are linearly aligned to permit the single keeper pin 43 to be inserted there through to permit the releasable connection of the support member 30 to the cross member 20. By selectively aligning the horizontal adjustment holes 44 with corresponding holes 39, and then inserting one or more to keeper pins 43 in the aligned holes, the horizontal position of the support member 30, in relation to the forked member 10 and thus with respect to the subfascia 50, can be adjusted and temporarily fixed by the user. Notably, there are a series of paired holes 44 arrayed along each side 27, 28 of the horizontal cross member 20, so that the horizontal position of the vertical support member 30 is selectively adjustable to accommodate finish fascia of different thicknesses.

The finish fascia board 60 is then oriented vertically, and its bottom edge rested upon the step ledges 55 defined by the inside top edges of the sides 34, 35 of the support member 30. The outside finished face of the finish fascia board 60 is rested against the fascia face 33 of the support plate 36.

Referring particularly to FIG. 9, the inventive apparatus is used to install finish fascia board 60 of varying widths and thicknesses at vertical and non-vertical angles at the eaves and gable ends of building roofs having rafters 63. Installation is accomplished while the apparatus is temporarily fastened to the sub fascia 50 from the bottom, either with or without the soffit 52 installed. The apparatus adjusts vertically to allow the bottom of the finish fascia board 60 to be positioned below the bottom of the soffit 52 at the bottom edge of the sub fascia 50, and also to allow the top of the finish fascia board 60 to be positioned past the roof deck 53 (when necessary, as in the application of support for roof tile 62) at the top edge of the sub fascia 50. The tool adjusts horizontally, depending upon which pair of holes 44 are employed, to allow for different thicknesses of finish fascia board 60.

The apparatus is readied for use by sliding the cross member 20 into the forked member 10 and inserting a pin 42, 42' into each side, into aligned holes 45, 18 in the two components 10, 20, and by then sliding the vertical support member 30 onto cross member 20 horizontally and inserting the pin 43 through both sides 28, 34 and 27, 35 into any holes 44, 39 aligned in the two components 30, 20.

The apparatus adjusts vertically in one-eighth inch increments to allow for differing widths of finish fascia and horizontally in one-quarter inch increments to allow for differing thicknesses of finish fascia. The apparatus adjusts easily for any predetermined size and/or placement of the finish fascia. To adjust the apparatus vertically, the user determines the measurement, in relation of the top of the finish fascia, to the top of the roof deck and/or the measurement, in relation of the bottom of the finish fascia, to the bottom of the soffit. The user then correlates the measurement to the apparatus, and uses the pin-and-hole combination to achieve the selected desired adjustment. To adjust the apparatus horizontally, the user adds one-eighth to one-quarter inch to the finish fascia thickness, and then adjusts the pin-and-hole combination to achieve the selected adjustment. The apparatus should not be adjusted with the finish fascia supported on the apparatus; rather, the finish fascia should be removed, the necessary adjustments made, the finish fascia replaced upon the apparatus, and the installation then performed.

To fasten the apparatus to the bottom of the sub fascia 50, the user marks a point about three-quarters of an inch from the outside vertical edge of the sub fascia, approximately center of where the finish fascia 60 is to be installed. The user then inserts a one and five-eighths inch dual torque flat head, yellow dichromate, coarse thread, decking screw 56 vertically halfway into the bottom of the sub fascia 50 at the marked point. The slotted hole 15 of the forked member 10 is placed up over the screw head, the apparatus is shifted sideways until the countersink 17 is directly above the screw head, and the screw 56 is tightened until the forked member 10 is snug against the sub fascia 50 with the head of the screw squarely in the countersink 17. The apparatus should be secured tight enough that it will not move while installing the finish fascia 60; however, the screw 56 should not be over-tightened, because the screw may fail.

To remove the apparatus from the bottom of the sub fascia 50, the screw 56 is loosened, the apparatus back-shifted sideways, the screw head is passed through the hole 15 to allow the apparatus to be lowered. The screw 56 is then tightened to draw its head flush to the surface, or the screw is removed and discarded.

In operation, therefore, the forked member is temporarily screwed to the bottom of the eave in a vertical downward position. The horizontal cross member is pinned to the forked member, using pairs of holes that permit the horizontal cross member to be at the proper vertical elevation to support the fascia in the proper position upon the vertical face of the eave. The bottom edge of the fascia may then be rested upon the cross member for support. The vertical support member then is pinned to the cross member in a position adjusted so that the support member clamps the fascia against the eave. While the apparatus thus supports the fascia, the user's hands are free to then permanently secure the fascia to the eave. When this is accomplished, the apparatus is dissembled by removing the keeper pins and detaching the forked member from the eave.

It will be noted and understood that since the apparatus is attachable to the bottom of the subfascia, regardless of the angular disposition of the subfascia, the apparatus finds beneficial use upon a non-vertical subfascia; the invention is adaptable for use to install fascia upon non-vertical surfaces. Further, it is apparent to one of skill in the art that the apparatus is useable to install fascia on the gable ends, as well, of conventional architectures.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all applications, patents, and publications cited above are hereby incorporated by reference.

I claim:

1. A portable apparatus for installing fascia upon a building having a roof and an eave, the eave having a subfascia, said apparatus comprising:

a forked member removably attachable to the eave, said member having two downwardly extending legs;

a cross member connectable to said legs of said forked member, said cross member adjustably movable vertically in relation to said forked member;

a vertical support member connectable to said cross member and slidably adjustable horizontally in relation to said cross member, said support member comprising surfaces for receiving and supporting the fascia in an installation position;

means for selectively temporarily fixing the vertical position of said cross member in relation to said forked member; and means for selectively temporarily fixing the horizontal position of said support member in relation to said cross member.

2. An apparatus according to claim 1 wherein said forked member comprises a base defining therein a slotted hole for receiving an attachment screw.

3. An apparatus according to claim 1 wherein said cross member comprises a pair of extending hooked arms, each arm defining an interior vertical channel for receiving, in slidable engagement, a corresponding one of said legs, wherein the slidable engagement of said legs in said vertical channels prevents horizontal movement of said cross member in relation to said forked member.

4. An apparatus according to claim 1 wherein said vertical support member defines an opening for receiving, in slidable horizontal inserted engagement, said cross member, wherein the slidable engagement of said cross member into said opening prevents vertical movement of said support member in relation to said cross member.

5. An apparatus according to claim 1 wherein said means for selectively temporarily fixing the vertical position of said cross member in relation to said forked member comprises:

at least one vertical adjustment hole defined in each of two opposing sides of said cross member;

a plurality of adjustment holes defined in said legs of said forked member, said holes selectively alignable with said vertical adjustment holes in said sides of said cross member; and a pair of keeper pins removably insertable in selectively aligned pairs of said adjustment holes.

6. An apparatus according to claim 1 wherein said means for selectively temporarily fixing the horizontal position of said support member in relation to said cross member comprises:

a plurality of horizontal adjustment holes defined in each of two opposing sides of said cross member;

at least one adjustment hole defined in each of two opposing sides of said support member, said holes selectively alignable with said horizontal adjustment holes in said sides of said cross member, and a pair of keeper pins removably insertable in selectively aligned pairs of said adjustment holes.

7. A portable apparatus for installing fascia upon a building having a roof and an eave, the eave having a subfascia, said apparatus comprising:

an eave member removably attachable to the eave, said eave member having at least one downwardly extending leg;

a cross member connectable to said at least one leg of said eave member, said cross member adjustably movable vertically in relation to said eave member;

a vertical support member connectable to said cross member and slidably adjustable horizontally in relation to said cross member, said support member comprising surfaces for receiving and supporting the fascia in an installation position;

means for selectively temporarily fixing the vertical position of said cross member in relation to said eave member; and means for selectively temporarily fixing the horizontal position of said support member in relation to said cross member.

8. An apparatus according to claim 7 wherein said eave member comprises a base defining therein a slotted hole for receiving a means for temporarily mounting said eave member to the eave.

9. An apparatus according to claim 8 wherein said cross member comprises a pair of extending hooked arms each arm defining an interior vertical channel for receiving, in slidable engagement, a corresponding one of said legs, wherein the slidable engagement of said legs in said vertical channels prevents horizontal movement of said cross member in relation to said eave member.

10. An apparatus according to claim 9 wherein said vertical support member defines an opening for receiving, in slidable horizontal inserted engagement, said cross member, wherein the slidable engagement of said cross member into said opening prevents vertical movement of said support member in relation to said cross member.

11. An apparatus according to claim 10 wherein said means for selectively temporarily fixing the vertical position of said cross member in relation to said eave member comprises:

at least one vertical adjustment hole defined in each of two opposing sides of said cross member;

a plurality of adjustment holes defined in said at least one leg of said eave member, said holes selectively alignable with said vertical adjustment holes in said sides of said cross member, and a pair of keeper pins removably insertable in selectively aligned pairs of said adjustment holes.

12. An apparatus according to claim 13 wherein said means for selectively temporarily fixing the horizontal position of said support member in relation to said cross member comprises:

a plurality of horizontal adjustment holes defined in each of two opposing sides of said cross member, at least one adjustment hole defined in each of two opposing sides of said support member, said holes selectively alignable with said horizontal adjustment holes in said sides of said cross member; and a pair of keeper pins removably insertable in selectively aligned pairs of said adjustment holes.

13. An apparatus according to claim 8 wherein said means for temporarily mounting comprises a screw.

* * * * *

UNITED STATES PATENT AND TRADEMARK OFFICE

CERTIFICATE OF CORRECTION

PATENT NO. : 6,527,265 B1
DATED : March 4, 2003
INVENTOR(S) : Clinton Goodding

It is certified that error appears in the above-identified patent and that said Letters Patent is hereby corrected as shown below:

Column 5,
Line 3, "Cave" should read -- Eave --

Column 6,
Line 14, "5-12" should read -- 5-10 --

Column 7,
Line 22, "5-12" should read -- 5-10 --

Column 9,
Line 10, "into" should read -- onto --

Column 12,
Line 24, in the preamble of claim 12, the claim dependency reference numeral "13" should read -- 11 --

Signed and Sealed this

Thirtieth Day of September, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,527,265 B1
DATED : March 4, 2003
INVENTOR(S) : Clinton Goodding

It is certified that error appears in the above-identified patent and that said Letters Patent is hereby corrected as shown below:

Column 5,
Line 3, “Cave” should read -- Eave --

Column 6,
Line 14, “5-12” should read -- 5-10 --

Column 7,
Line 22, “5-12” should read -- 5-10 --

Column 9,
Line 10, “into” should read -- onto --

Column 12,
Line 24, in the preamble of claim 12, the claim dependency reference numeral “13” should read -- 11 --

Signed and Sealed this

Twenty-first Day of October, 2003

JAMES E. ROGAN
*Director of the United States Patent and Trademark Office*